US007398943B2

(12) United States Patent
Horneck et al.

(10) Patent No.: US 7,398,943 B2
(45) Date of Patent: Jul. 15, 2008

(54) APPARATUS FOR WINDING PAPER WITH STATIC CONTROL

(75) Inventors: Craig F. Horneck, Aiken, SC (US); James A. McDavid, North Augusta, SC (US); Emily E. Elbert, Evans, GA (US); Peter M. Parviainen, Martinez, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 454 days.

(21) Appl. No.: 11/165,973

(22) Filed: Jun. 24, 2005

(65) Prior Publication Data

US 2006/0289692 A1 Dec. 28, 2006

(51) Int. Cl.
*B65H 18/08* (2006.01)

(52) U.S. Cl. ..... 242/534; 242/535.4; 242/541.3; 361/214

(58) Field of Classification Search ..... 242/534, 242/541.3, 535.4; 361/214, 225, 230, 231, 361/233

See application file for complete search history.

(56) References Cited

U.S. PATENT DOCUMENTS

| | | | | |
|---|---|---|---|---|
| 3,787,706 A | | 1/1974 | De Geest | |
| 4,547,060 A | * | 10/1985 | Lindblad | 399/175 |
| 5,041,941 A | | 8/1991 | Carter et al. | |
| 5,374,979 A | * | 12/1994 | Kobayashi | 399/89 |
| 5,607,551 A | | 3/1997 | Farrington, Jr. et al. | |
| 5,901,918 A | | 5/1999 | Klerelid et al. | |
| 5,944,273 A | | 8/1999 | Lin et al. | |
| 6,698,681 B1 | | 3/2004 | Guy et al. | |
| 2005/0145743 A1 | * | 7/2005 | Clarke et al. | 242/535.4 |

FOREIGN PATENT DOCUMENTS

GB 1 600 077 A 10/1981

OTHER PUBLICATIONS

American Society for Testing Materials (ASTM) Designation: D 737-96, "Standard Test Method for Air Permeability of Textile Fabrics," pp. 207-211, published Apr. 1996.

* cited by examiner

*Primary Examiner*—Peter M. Cuomo
*Assistant Examiner*—Sang Kim
(74) *Attorney, Agent, or Firm*—Gregory E. Croft

(57) ABSTRACT

An apparatus and method for winding a roll is disclosed. The apparatus engages a reel spool against an endless flexible belt spanning two rolls to form an unsupported span of the belt. The tissue web is carried to the free span on the endless flexible belt, and the reel spool is pushed into the endless flexible belt in the free span winding the roll. A displacement sensor measures the deflection of the endless flexible belt during winding, and, in response, the reel spool position is changed to control the deflection at a desired level. Located within the apparatus are at least one static measurement probe, and at least one static induction device. The probe and the static induction device are used to measure and control the static charge of the tissue web, the transfer belt, or both. By maintaining a predetermined static charge differential between the transfer belt and the tissue web, the reel will have improved web handling and/or transfer efficiency.

16 Claims, 3 Drawing Sheets

APPARATUS FOR WINDING PAPER WITH STATIC CONTROL

BACKGROUND

In the manufacture of various types of tissue products such as facial tissue, bath tissue, paper towels and the like, the dried tissue web or tissue sheet coming off of the tissue machine is initially wound into a parent roll and temporarily stored for further processing. Sometime thereafter, the parent roll is unwound and the tissue web is converted into a final product form.

In winding the tissue web into a large parent roll, it is vital that the roll be wound in a manner which prevents major defects in the roll and which permits efficient conversion of the roll into the final product, whether it be boxes of facial tissue sheets, rolls of bath tissue, rolls of embossed paper towels, and the like. Ideally, the parent roll has an essentially cylindrical form, with a smooth cylindrical major surface and two smooth, flat, and parallel end surfaces. The cylindrical major surface and the end surfaces should be free of ripples, bumps, waviness, eccentricity, and wrinkles, i.e. the roll should be substantially uniform. Likewise, the parent roll must be stable, so that it does not depart from its cylindrical shape during storage or routine handling, i.e. the roll should be dimensionally stable. Defects can force entire parent rolls to be scrapped if they are rendered unsuitable for high speed conversion.

New tissue reels having an endless flexible belt, disclosed in U.S. Pat. No. 5,901,918 entitled *Apparatus and Method for Winding Paper* that issued May 11, 1999 to Klerelid et al., are effective in the winding of tissue and paper webs. In particular, tissue webs having a bulk of 9 cubic centimeters per gram or higher and a high level of softness, as characterized, for example, by an MD Max Slope of about 10 kilograms or less per 3 inches of sample width are especially suited to winding on such reels. Such reels and winding methods can be used to produce substantially uniform and dimensionally stable parent rolls of such soft tissue webs having diameters on the order of 70 to 150 inches. Such parent rolls are disclosed in U.S. Pat. No. 5,944,273 entitled *Parent Roll for Tissue Paper* that issued Aug. 31, 1999 to Lin et al.

As the machine speed of the belted reel disclosed in U.S. Pat. No. 5,901,918 is increased, web handling can become a problem. In particular, the tissue web can wander or be loosely affixed to the transfer belt, causing an uneven parent roll during winding and/or problems in effecting an efficient transfer to a new reel spool during a transfer when the tissue web is changed from winding onto the full diameter parent roll and directed to winding on a new reel spool. One method of solving this problem is to use vacuum boxes beneath the transfer belt to securely hold the tissue web to the transfer belt, as disclosed in U.S. Pat. No. 6,698,681 entitled *Apparatus and Method for Winding Paper* that issued Mar. 2, 2004, to Guy et al. However, such a solution requires an air permeable transfer belt, which may not always be desirable. Additionally, vacuum boxes are prone to becoming plugged with excess tissue dust and can be a fire or explosion hazard. The exhaust must be sent to a dust removal system, which adds more cost and complexity. Vacuum boxes and dust removal systems require frequent cleanings to ensure safe, reliable operation. Vacuum boxes are only effective to control the tissue web in the immediate area where they are located, and it is difficult to locate them along the entire length of the transfer belt in the reel section. Finally, transfer belt wear can be an issue if tissue dust builds up between the vacuum box and the fabric.

Therefore, there is still a need for an apparatus and method of winding paper webs, especially bulky tissue webs, at faster production speeds having improved web stability in order to wind more uniform parent rolls. There is also still a need for an apparatus and method for maintaining especially good tissue web control during a transfer to manufacture such webs cost effectively.

SUMMARY

These and other needs are met by the apparatus and method according to the present invention, which includes an endless flexible belt having a winding region for engaging the tissue web against a reel spool and a web transport region. The endless flexible belt forms a soft nip with the reel spool. A displacement sensor measures the amount of deflection of the flexible belt. The amount of deflection is related to the pressure at the nip point and, by moving the reel spool and flexible belt away from each other as the diameter of the paper roll increases, the pressure can be controlled at a desired level. Accordingly, the tissue web winding parameters are greatly improved and the differences in properties of the tissue roll can be minimized.

To maintain tissue web control and to improve transfer efficiency, the static charge difference between the tissue web and the endless flexible belt is monitored and controlled within a desired range to attract the tissue web to the endless flexible belt. Unlike a vacuum box with a limited area of influence, the static force will hold the tissue web securely along the entire length of the tissue web that is adjacent to the endless flexible belt. If the static charge is too low, web wandering and poor transfer efficiency can occur from the windage lifting the tissue web off the endless flexible belt leading to a transfer failure. If the static charge is too high, the tissue web can be stuck too firmly to the endless flexible belt and not properly wrap the reel spool during a transfer, causing a large number of missed transfers.

Hence, in one aspect, the invention resides in an apparatus for winding a web into a roll, including: a rotatably mounted reel spool; an endless flexible belt mounted for rotation along a predetermined path of travel having a winding region and a web transport region, with the winding region positioned adjacent to the reel spool; a displacement sensor measuring a deflection of the endless flexible belt from the predetermined path of travel in the winding region; an actuator for positioning the reel spool and the endless flexible belt relative to each other to vary the deflection of the endless flexible belt; a controller connected to the displacement sensor and the actuator for controlling the deflection of the endless flexible belt as the roll increases in diameter; and at least one static measurement probe measuring the charge of at least of the endless flexible belt and the web, and at least one static induction device for inducing a static charge into at least one of the endless flexible belt and the web.

In another aspect, the invention resides in an apparatus for winding a web of paper into a roll, including: a rotatably mounted reel spool; a drive motor connected to the reel spool for winding a paper web thereon to create a parent roll of increasing diameter; an air permeable endless flexible belt having an inside surface and an outside surface supported for rotation around a plurality of support rolls defining a predetermined path of travel, the predetermined path of travel having a winding region including a free span and a pair of support rolls, and a web transport region preceding the winding region, the paper web residing on the outside surface and positioned adjacent to the reel spool engaging the reel spool during winding such that the free span is deflected from the predetermined path of travel by the paper web winding on the reel spool; a displacement sensor mounted within the endless flexible belt measuring a deflection of the inside surface from the predetermined path of travel; an actuator for positioning the reel spool and the endless flexible belt relative to each other to vary the deflection of the inside surface; a controller connected to the displacement sensor and the actuator for controlling the deflection of the inside surface as the parent roll diameter increases; and at least one static measurement probe measuring the charge of at least one of the endless flexible belt and the paper web and at least one static induction device for inducing a static charge into at least one of the endless flexible belt and the paper web.

In another aspect, the invention resides in a method of winding a web to form a roll, including the steps of: engaging a reel spool against an endless flexible belt creating a nip such that the flexible belt is deflected from a predetermined path of travel, the endless flexible belt having a winding region, and a web transport region; rotating the reel spool and the endless flexible belt; advancing the web into the nip and directing the web around the reel spool to form a roll of increasing diameter; sensing the amount of deflection of the endless flexible belt by the roll as the diameter of the roll increases; moving at least one of the reel spool and the endless flexible belt in response to the sensing step to vary the amount of deflection of the endless flexible belt; measuring the static charge of at least one of the web and the endless flexible belt; and inducing a static charge into at least one of the web and the endless flexible belt.

In another aspect, the invention resides in a method of controlling a web, including the steps of: monitoring the static charge level of the web, inducing a static charge in the web, and controlling the static charge of the web at a predetermined level other than zero.

BRIEF DESCRIPTION OF THE DRAWINGS

The above aspects and other features, aspects, and advantages of the present invention will become better understood with regard to the following description, appended claims, and accompanying drawings where:

Figure 1:
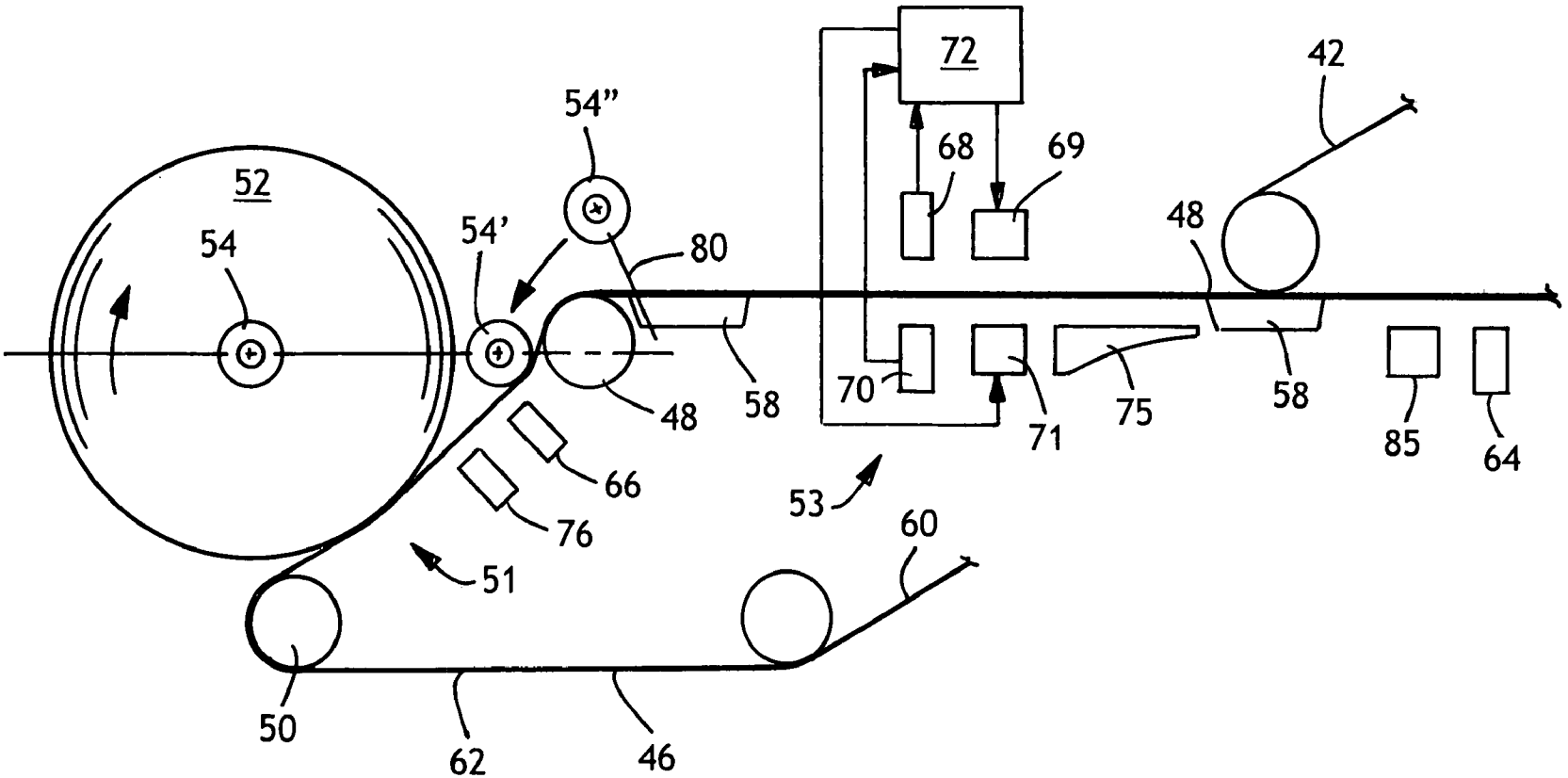
FIG. 1 illustrates a schematic diagram of a belted reel in accordance with one embodiment of the invention.

Repeated use of reference characters in the specification and drawings is intended to represent the same or analogous features or elements of the invention.

DETAILED DESCRIPTION

It is to be understood by one of ordinary skill in the art that the present discussion is a description of exemplary embodiments only and is not intended as limiting the broader aspects of the present invention, which broader aspects are embodied in the exemplary construction.

Figure 2:
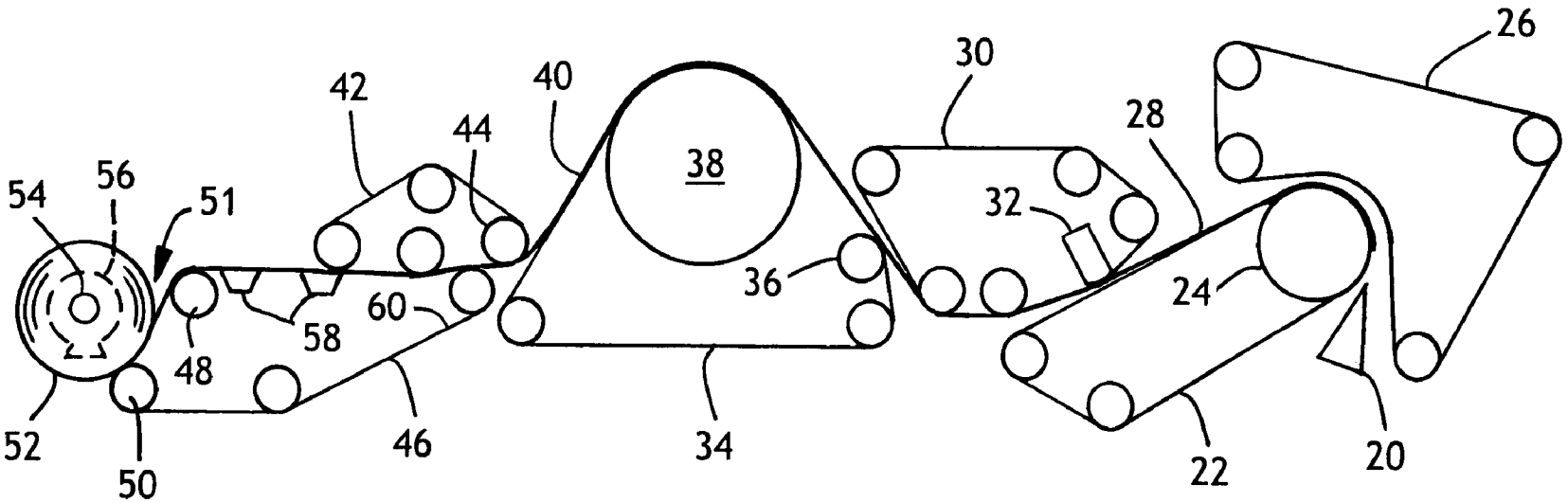
FIG. 2 illustrates a schematic diagram of a method for making soft high bulk tissue webs on a tissue machine having the reel of FIG. 1.

Referring to FIGS. 1 and 2, a tissue machine and a reel is shown schematically. The process can be used for making uncreped through-air dried tissue webs. It should be understood, however, that the present invention could also be used with the creping process for tissue webs or with other types of winders or reels. Shown is a headbox 20 which deposits an aqueous suspension of papermaking fibers onto an inner forming fabric 22 as it traverses a forming roll 24. An outer forming fabric 26 serves to contain the wet web 28 while it passes over the forming roll and sheds some of the water. The wet web 28 is then transferred from the inner forming fabric to a wet end transfer fabric 30 with the aid of a vacuum transfer shoe 32. This transfer is preferably carried out with the transfer fabric traveling at a slower speed than the inner forming fabric (rush transfer) to impart stretch into the final dry tissue web. The wet web is then transferred to the through-air drying fabric 34 with the assistance of a vacuum transfer roll 36.

The through-air drying fabric 34 carries the wet web over a through-air dryer 38, which moves hot air through the wet web to dry it while preserving bulk. There can be more than one through-air dryer in series (not shown), depending on the speed and the dryer capacity. The dried tissue web 40 is then transferred to a first dry end transfer fabric 42 with the aid of a vacuum transfer roll 44.

The tissue web, shortly after transfer, is sandwiched between the first dry end transfer fabric 42 and the transfer belt 46 to positively control the web's path. The transfer belt can be air permeable or impermeable as desired. In one embodiment, the transfer belt can have an air permeability of greater than about 50 cubic feet per minute per square foot of fabric (cfm/ft$^2$). More specifically, the transfer belt can have an air permeability of from about 100 to about 300 cfm/ft$^2$, and still more specifically from about 125 to about 180 cfm/ft$^2$. Air permeability, which is the air flow through a fabric while maintaining a differential air pressure of 0.5 inches of water across the fabric, is tested in accordance with ASTM test method D737-96 entitled "Test Method for Air Permeability of Textile Fabrics." A copy of the test method is available from ASTM International, having an office at 100 Barr Harbor Drive, West Conshohocken, Pa. 19428-2959 USA. The air permeability of the transfer belt 46 can be less than that of the first dry end transfer fabric 42, causing the tissue web to naturally adhere to the transfer belt. At the point of separation, the tissue web 40 can follow the transfer belt 46 due to vacuum action. In addition, the transfer belt 46 is preferably smoother than the first dry end transfer fabric 42 in order to enhance transfer of the tissue web 40. To further effectuate a smooth transfer, a vacuum box, a coanda vacuum box, or other pressure reduction means 58, can be located beneath the transfer belt 46, near the point of separation of the transfer belt and the first dry end transfer fabric 42 to assist in transferring the tissue web 40 to the transfer belt.

Suitable paper machine fabrics for use as a transfer belt include, without limitation: A 960C fabric having an air permeability of 0 cfm/ft$^2$, or a 960E fabric having a permeability of 170 cfm/ft$^2$, or a 960W fabric, having an air permeability of 150 cfm/ft$^2$, or a WAJ-177 fabric having an air permeability of 177 cfm/ft$^2$. All of the preceding fabrics are available from AstenJohnston having an office at 6480 W. College Avenue, Appleton, Wis., USA.

The transfer belt 46 passes around an upper support roll 48 and a lower support roll 50, having a free span between them, which defines a winding region 51 that includes both support rolls. The portion of the transfer belt 46 upstream of the upper support roll 48 and downstream of the first dry end transfer fabric 42 defines a web transport region 53 where the tissue web 40 is conveyed by the transfer belt 46 to the winding region 51. The transfer belt 46 returns to pick up the tissue web 40 again by use of one or more support or guide rolls, as known to those of skill in the art. The tissue web 40 is transferred to a parent roll 52 within the winding region 51. The parent roll 52 is wound on a reel spool 54, which is driven by a drive motor 56 acting on the shaft of the reel spool.

In order to monitor and control the static charge within the belted reel (the winding region 51 and the web transport region 53), the apparatus includes one or more static measurement probes and one or more static induction devices (SID). Referring to FIG. 1, the belted reel includes a transfer static probe 64 located upstream of the point of transfer of tissue web 40 from the dry end transfer fabric 42 to the transfer belt 46. This probe can be used to monitor the level of static charge built up on the transfer belt during operation. The belted reel has a winding static probe 66 located in the winding region 51 near where reel spool 54' touches the transfer belt 46 to initiate a transfer. This probe can be used to monitor the static charge present on the transfer belt 46 prior to or during a transfer, or while winding a parent roll 52. The belted reel also has a tissue web static probe 68 located in the web transport region 53, above the tissue web 40, to monitor the static charge on the tissue web as a result of a static charge induced into the tissue web by a tissue web SID 69. The tissue web SID 69 is used to adjust the level of static charge present on the tissue web 40 and is placed adjacent the tissue web in the web transport region 53. Finally, the belted reel has a transfer belt static probe 70 located in the web transport region 53 to monitor the static charge on the transfer belt 46 as a result of a static charge induced into the transfer belt by a transfer belt SID 71. The transfer belt SID 71 is used to adjust the level of static charge present on the transfer belt 46 and is placed adjacent to the transfer belt 46 in the web transport region 53.

The static probes (68, 70) and the SIDs (69, 71) in the web transport region 53 can be located at any position within the web transport region. They may be placed directly opposite each other as drawn, or they may be staggered along the length of the transfer belt 46. It may be desirable to locate the devices closer to the winding region 51 to more closely control the static charge difference during transfer. Alternatively, it may be more desirable to locate the devices closer to the separation point between the first dry end transfer fabric 42 and the transfer belt 46 to more closely control the static charge difference in the web transport region 53. Alternatively, two complete sets of SIDs and static probes can be located within the belted reel, such as a set near the winding region 51 and a set near the separation point. The optimum static charge differential for winding and transferring to a new reel spool may be different than the optimum static charge differential during tissue web transport. Multiple sets could allow for maintaining two distinct levels of static charge differences within the belted reel.

The static probes (68, 70) and the SIDs (69, 71) should be located sufficiently close to the tissue web 40 and the transfer belt 46 to accurately measure the static level and to affect a change in the static level by the use of a control system 72. In general, the devices should be located as close as practical to the tissue web 40 or transfer belt 46, recognizing that some gap is necessary for threading and operating the reel. In general, the gap between the static probe and/or the SID to the moving surface of the tissue web 40 or the transfer belt 46 should be between approximately 0.25 inch to about 2 inches. In one embodiment, both gaps were approximately 0.75 inch.

Depending on the maximum length of the free span of the transfer belt 46 in the winding region, it may be desirable to locate the static probes (68, 70) and the SID's (69, 71) close to an optional foil 75. The static probes (68, 70) and the SID's (69, 71) can be located either upstream or downstream. In one embodiment, they were adjacent to the downstream end of the foil. The foil 75 can be used to reduce the flutter of the transfer belt 46 such that the static probes (68, 70) and the SID's (69, 71) can be located closer to the moving surfaces of the tissue web 40 and the transfer belt 46. Instead of the foil 75, a roller or other support device can be used to increase the stability of the transfer belt 46 in the web transport region 53.

Suitable static measurement probes and SID's are made by several manufacturers. One suitable system for monitoring the static charge at the various points in the belted reel is a four channel electrostatic field meter system Model 177-1 using Model 1036E electrostatic field meter probes manufactured by Monroe Electronics, 100 Housel Ave., P.O. Box 317 High Bridge, N.J. 08829. One suitable SID system for inducing a static charge into either the tissue web or the transfer belt includes a Glassman power supply (Glassman High Voltage Inc., 124 West Main Street, P.O. Box 317 High Bridge, N.J. 08829) and Hurletron static charge bars (Hurletron, 1820 Tempel Drive, Libertyville, Ill. 60048).

The output of one or more of the static probes can be used as an input to the control system 72. The tissue web and the transfer belt SID's (69, 71) can be controlled by the control system 72 in combination with a desired set point to maintain either the tissue web charge, the transfer belt charge, or the differential between the static levels within a specific range. For example, the control system 72 monitors the tissue web charge using the tissue web static probe 68 and monitors the transfer belt charge using the transfer belt static probe 70. The control system then turns on or off or adjusts the level of either the tissue web SID 69 or the transfer belt SID 71 or both to maintain a static charge difference between the tissue web 40 and the transfer belt 46.

The inventors have determined that relative humidity is a key component that affects the static charge build up on both the tissue web 40 and the transfer belt 46. In particular, they have discovered that as the level of relative humidity increases, the transfer belt's static level changes much more than the corresponding change in the tissue web's static level. Without wishing to be bound by theory, this may be a result of the moisture level of the tissue web as compared to the transfer belt. As a result, as the relative humidity increases, the static charge differential between the tissue web and the transfer belt is increased rather than staying constant or decreasing. Depending on the magnitude of the charge difference, web handing problems can occur.

With further investigation, the inventors have determined that if the static charge difference between the tissue web 40 and the transfer belt 46 is too low, poor web handling, wandering, or wrinkles can occur in the web transport region 53. Additionally, the portion of the tissue web 40 between the upper support roll 48 and the parent roll 52 can be destabilized by the forces acting on the tissue web during a transfer. For instance, the spinning reel spool 54' can create enough windage to pull all or a portion of the tissue web 40 away from the transfer belt 46 prior to the reel spool 54' contacting the transfer belt. This can cause a loose, uncontrolled, or wrinkled winding on the new reel spool. If the winding of the reel spool 54' is not started uniformly, the tissue web 40 often will tear and break before the transfer is completed. The partially torn tissue web 40 and other broken pieces can get caught in the nip breaking off the tissue web leading to a failure. To avoid these problems, the inventors have determined that the charge difference between the tissue web and the transfer belt should be about 6 kilovolts or greater.

However, if the charge difference between the tissue web and the transfer belt is too great, then the tissue web can be stuck so hard to the transfer belt that it will tend to travel with the transfer belt instead of wrapping the new reel spool 54' during a transfer. Generally, reel spools have a vacuum zone that is used to pick up and initiate transfer of the tissue web 40 off of the transfer belt 46. With too large of a static differential, the vacuum is unable to overcome the attractive forces of the tissue web 40 to the transfer belt 46 or the tissue web may hesitate prior to transferring, leading to a non-uniform start. To avoid these problems, the inventors have determined that the charge difference between the tissue web and the transfer belt should be about 20 kilovolts or less.

Thus, to maintain good web control and improved transfer efficiencies, the static charge differential between the transfer belt and the tissue web should be between about 6 kilovolts to about 20 kilovolts, or for even better web control, between about 9 kilovolts to about 18 kilovolts. Furthermore, the inventors have determined that the tissue web 40 tends toward a negative static charge level naturally in the manufacturing process, while the transfer belt static charge, if left uncontrolled, can be either positive or negative. Desirably, the tissue web static charge is maintained in a range between about −20 kilovolts to about 0 kilovolts, such as between about −15 kilovolts to about −5 kilovolts. Similarly, the transfer belt static charge level is maintained in a range between about 0 kilovolts to about +20 kilovolts, such as between about +5 kilovolts to about +15 kilovolts. Desirably, the tissue web 40 is maintained at a negative static charge and the transfer belt 46 at a positive static charge with the static charge differential maintained within the above stated range. However, the charges could be reversed or both could be positive or negative, as long as there is a static attraction between the tissue web 40 and the transfer belt 46.

Depending on the level of static charge for the incoming tissue web 40 or the transfer belt 46 to the web transport region 53, one or more static reduction devices 85 may be required to reduce the incoming static charge of the tissue web, the transfer belt, or both. The static reduction device 85 can be any device known to reduce or eliminate static, such as tinsel, a grounded or active SID bar, or other means known to those of skill in the art. Reducing or eliminating the incoming static charges can enhance the performance of the control system 72 to maintain the desired static charge difference and the desired static charge potential of the tissue web 40 and the transfer belt 46. If the incoming static charge is too high, the control system may not be able to compensate as desired.

It is possible to manually maintain the static charge difference by monitoring the static charges of the tissue web 40 and transfer belt 46 and adjusting either or both SID's as needed. Preferably, to maintain this difference irrespective of changes in relative humidity, changes in the tissue web, or other factors, the control system 72 is used to control the charge differential within a specific range.

For example, during winding of the parent roll 52, the control system 72 can be used to send a set point of −5 kilovolts to the tissue web SID 69 and to send a set point of +5 kilovolts to the transfer belt SID 71. Depending on the incoming static charges of the tissue web 40 and transfer belt 46, the induced static charge in the tissue web or transfer belt may not equal that of the set point. However, the tissue web static probe 68 and the transfer belt static probe 70 can be used to measure the static charge differential to ensure it is within the desired range.

During a transfer when increased sheet stability may be required, the set points for tissue web SID 69 and the transfer belt SID 71 may be increased. In one embodiment, approximately three minutes before a transfer is initiated, the control system can be used to send a set point to the tissue web SID 69 of approximately −15 kilovolts and to send a set point to the transfer belt SID 71 of approximately +15 kilovolts. Then the control system can monitor the actual measured static charges on the tissue web 40 and transfer belt 46 to determine the static charge differential. If the differential is less than approximately 6 kilovolts, the set points for each SID are increased by 1 kilovolt. Approximately 45 seconds is allowed for equilibrium to be established and the static charge differential is again determined. If the difference is again too low, the set points are increased again by 1 kilovolt and the transfer is initiated shortly thereafter even though the static charge differential may not be within the optimal range. Because a transfer happens over a relatively brief period in the winding cycle, there may not be sufficient time to always reach the desired static charge differential before the transfer must be initiated. Similarly, if the static charge differential is greater than approximately 20 kilovolts, then both set points are reduced by a 1 kilovolt increment in a maximum of two steps to try and reduce the static charge differential to the optimal range. Of course, if the static charge differential is within the optimal range, no charges are made to the set points. It may be desirable to program the control system 72 with a slower feedback loop since response to changes in the set points of the SID's (69, 71) by the tissue web 40 or transfer belt 46 can take time to be measured by the static probes (68, 70).

Maintaining a static charge differential on a paper web, or other flexible web, for improved process control has other applications in addition to the belted reel. For example, in chilled roll tacking, a controlled static charge can be applied to the web such that it is attracted to the chilled roll. This can reduce the air gap between the web and the roll surface, which in turn can reduce condensation on the roll to eliminate streaking. Reduction in the air gap can promote improved temperature transfer as well. In web coating, maintaining a specific charge level to the paper web can help in a more uniform coating layer. In bindery card tacking, a controlled static charge can be applied to the cards that are inserted into the signature pockets during the binding cycle to prevent the cards from falling out downstream of the insertion point. In ribbon or web tacking, a positive charge can be applied to one side of the ribbon and a negative charge applied to the opposite side. This can result in the elimination of air pockets and produce a temporary adhesion that can reduce dog-ears and web wandering. In stack tacking, a static charge can be applied to a magazine or book on the incline of a stacker to create a bond between the magazines or books to provide a tighter more aligned stack. In bundle tacking, a static charge can be applied to a completed bundle to maintain the integrity of the bundle or stack. In web transfers or roll starting, a charge differential can be maintained between the web and the new core in order to start a new roll and eliminate the need for gluing the tail to the core. Thus, there are numerous applications where a purposely induced static charge differential between a web and one or more components of a machine can be useful in the processing of the web. An automatic control system monitoring a static probe to sense the charge level (static feedback loop) can send an output to a static induction device in order to maintain the static differential within an optimum range for each process or to maintain the web at a predetermined static charge other than zero.

Referring to FIG. 1, located along at least a portion of the transfer belt's predetermined path within the web transport region 53 is an optional means for pressure reduction 58. The pressure reduction means reduces the pressure along a portion of an inside surface 60 of the transfer belt 46. Such pressure reduction means can include without limitation, a vacuum box, a vacuum roll, a spoiler bar, a coanda vacuum box, a venturi, a fan, or a vacuum pump.

As illustrated, two coanda vacuum boxes function as the pressure reduction means 58 and they are located in the web transport region 53. A coanda vacuum box uses high velocity air directed along a curved surface to create a low pressure zone upstream of the curved surface. Coanda vacuum boxes are commercially available from Metso Corporation, having an office at SE-651, Karlstad, Sweden. This type of pressure reduction means is desirable for this application since it is not necessary for the coanda vacuum box to touch the inside surface 60 of the transfer belt in order to create a reduced pressure adjacent the inside surface 60. The coanda vacuum box can be located within approximately one inch of the transfer belt 46 and still have the desired functionality. However, other pressure reduction means, such as a conventional vacuum box with seals to the moving transfer belt 46, could be used.

Desirably, the optional pressure reduction means 58 are located in an area when additional web stability is required in the web transport region 53. Such areas can include the area preceding the upper support roll 48 or the area where the first dry end transfer fabric 42 and the transfer belt 46 separate in order to ensure positive transfer of the tissue web 40 to the transfer belt. The pressure reduction means 58 in the web transport region 53 helps to stabilize the tissue web 40, reducing skating and weaving, improving tissue machine runnability and the parent roll's uniformity. Generally, the coanda vacuum boxes in the web transport 53 region will operate at a vacuum level of approximately 0-2 inches of water.

The transfer and winding of the web is illustrated in more detail in FIG. 1. In the winding region 51, the tissue web 40 contacts and transfers to the parent roll 52. Reference numbers 54, 54' and 54" illustrate three positions of the reel spool during continuous operation. As shown, a new reel spool 54" is ready to advance to position 54' as the parent roll 52 is building. When the parent roll has reached its final predetermined diameter, the new reel spool 54" is lowered by a pair of arms 80 into position 54' and against the incoming tissue web 40 at some point along the winding region 51 between the upper support roll 48 and the lower support roll 50. Desirably, the contact point is close to the upper support roll 48 without touching the upper support roll so as to avoid a hard nip between the upper support roll and the reel spool.

At the appropriate time, one or more air jets 78 (FIG. 3) serve to blow the tissue web 40 back toward the new reel spool 54' to aid in attaching the tissue web to the new reel spool. Specifically, two side air jets can be located to blow towards the ends of the reel spool 54' and one or more air jets can be located adjacent to both edges of the tissue web 40 blowing towards the cylindrical surface of the reel spool 54'. The reel spool 54 can comprise a conventional vacuum reel spool with apertures such that vacuum suction from within the reel spool helps to hold the tissue web and initiate the winding process. As the tissue web is transferred to the new reel spool, the tissue web is broken and the parent roll 52 is kicked out to continue the winding process with a new reel spool.

Figure 3:
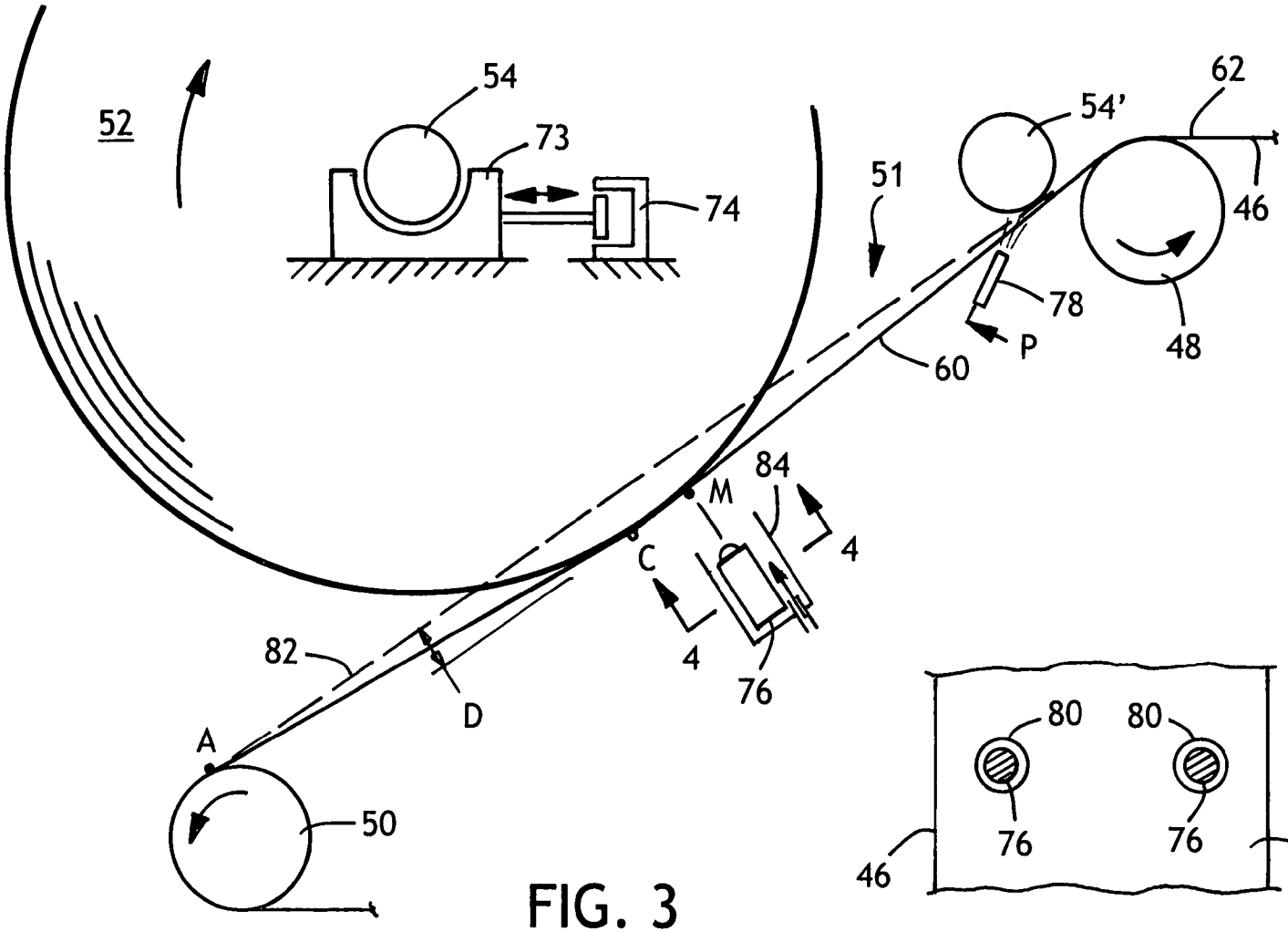
FIG. 3 illustrates an enlarged schematic diagram of the winding section, illustrating the operation of a displacement sensor in controlling the transfer belt displacement.

Referring now to FIG. 3, more details of the reel are illustrated. The reel spool 54 is supported appropriately by a pair of carriages 73, one of which is illustrated in FIG. 3. As the parent roll 52 builds, the reel spool moves toward the other support roll 50 while at the same time moving away from the transfer belt 46. The reel spool 54 can be moved in either direction by a hydraulic cylinder 74, as illustrated by the double-ended arrow, to maintain the proper transfer belt deflection needed to minimize the variability of the roll properties during the winding process. As a result, the parent roll nip substantially traverses the winding region 51 as the roll builds to its predetermined size.

Control of the relative positions of the reel spool 54 from the transfer belt 46 is suitably attained using a displacement sensor 76, which is focused on inside surface 60 of the transfer belt 46, preferably at a point M midway between the two support rolls (48, 50) as illustrated in FIG. 3. One object is to control the pressure exerted by the parent roll 52 against the tissue web supported by the transfer belt 46 as well as controlling the nip length created by the contact. The displacement sensor 76, such as a laser displacement sensor discussed below, detects changes in transfer belt deflection of as small as 0.005 inches. A predetermined baseline value, from which the amount of deflection D can be ascertained, is the undeflected travel path of the transfer belt 46 without parent roll 52 present, as illustrated by a dashed line 82.

A particularly suitable displacement sensor 76 is a laser displacement sensor Model LAS-8010, manufactured by Nippon Automation Company, Ltd. and distributed by Adsens Tech, Inc. Other suitable contacting and non-contacting displacement sensing devices for measuring the transfer belt deflection known to those of skill in the art can be used as well. The Nippon Automation LAS 8010 sensor has a focused range of 140 mm to 60 mm and is connected to a programmable logic controller. The front plate of the sensor can be mounted 120 mm from the inside surface of the transfer belt. Such a sensor is designed to give a 4 to 20 mA output in relation to the minimum to maximum distance between the laser displacement sensor and the transfer belt. The belted reel is first operated without a parent roll 52 loaded against the transfer belt 46 to set the zero point in the programmable logic controller based on the undeflected path of travel 82 of the transfer belt.

The laser displacement sensor 76 is preferably mounted within an air purge tube 84 which maintains an air flow around the laser to prevent dust from settling on the lens of the laser and interfering with the operation of the device. The laser and air tube can be mounted by suitable components as known by those of skill in the art within the belted reel.

Once the transfer belt deflection D has been measured, a proportional only control loop associated with the programmable logic controller desirably maintains that deflection at a constant level. Other automated control logic known to those of skill in the art, such as a PID control loop, can be used instead. In particular, the output of this control is the setpoint for a hydraulic servo positioning control system for the carriages 73, which hold the reel spool 54 and the building parent roll 52. Other mechanical and electrical actuators for positioning the reel spool 54 in response to the displacement sensor 76, in order to maintain a constant deflection D, can be designed and constructed by those skilled in the art of building winders. When the transfer belt deflection D exceeds the setpoint, the carriage position setpoint is increased, thereby moving the carriages 73 away from the transfer belt 46 and returning the deflection to the setpoint.

Control of the web properties of the tissue web unwound from the parent roll 52 can be aided by imparting a predetermined amount of web tension to the incoming web during winding, such as by programming the level of speed difference between the transfer belt 46 and the outer surface of the building parent roll 52. In most instances, a positive draw (the percentage by which the speed of the surface of the parent roll exceeds the speed of the transfer belt) is desired at the parent roll in order to impart the web tension needed to provide a stable parent roll. On the other hand, too much positive draw will unacceptably reduce the machine direction stretch in the web. Therefore, the amount of positive draw will depend upon the web properties coming into the parent roll and the desired properties of the web to be unwound from the parent roll. Generally, the surface speed of the parent roll 52 will be about 10 percent faster or less than the surface speed of the transfer belt 46, more specifically from about 0.5 to about 8 percent faster, and still more specifically from about 1 to about 6 percent faster. Of course, if the tissue web 40 approaching the parent roll 52 already has sufficient tension provided by other means earlier in the tissue making process, a negative or zero draw may be desirable.

Figure 4:
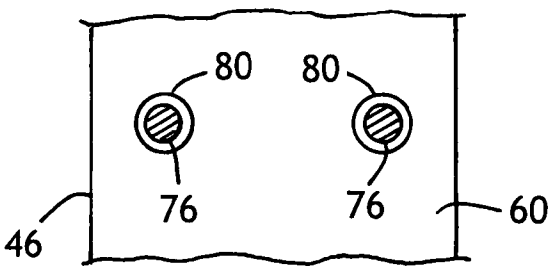
FIG. 4 illustrates a partial sectional view taken through line 4-4 of FIG. 3.

Measurement of the transfer belt deflection may instead use two laser distance sensors, each sensing the inside surface 60 and located adjacent a respective edge of the transfer belt 46, so as to be spaced from each other in the cross machine direction, as can be seen in FIG. 4. As such, undesirable tapering of the parent roll 52 can be minimized by adjusting each carriage 73 independently or a positive taper can even be introduced intentionally to improve the winding parameters of the particular roll being wound. Alternatively, the average displacement of the two displacement sensors can be used by the control system.

In one embodiment, the hydraulic servo positioning system used Moog servo valves controlled by an Allen-Bradley QB module with Temposonic transducers mounted on the rods of the hydraulic cylinders 74 to determine their position. The output from the deflection control loop is the input to two individual servo positioning systems on either side of the reel. Each system can then control independently, keeping the two sides of the reel spool in line and parallel to the support rollers (48, 50) if desired. A protection system that stops the operation if the parallelism exceeds a certain threshold level may be desirable, but it is not necessary to have an active system to keep the two sides parallel.

The extent to which the transfer belt 46 is deflected is suitably maintained at a level of about 20 millimeters or less, more specifically about 10 millimeters or less, still more specifically about 5 millimeters or less, and still more specifically from about 1 to about 10 millimeters. In particular, the control system preferably maintains the actual transfer belt deflection at the nip at a level of about 4 mm±2 mm. Maintaining the transfer belt deflection within this range has been found to allow the parent roll 52 and the transfer belt 46 to operate with a relative speed differential but without significant power transfer. This will allow control of the winding process to maintain substantially constant web properties throughout the parent roll 52.

Deflection of the transfer belt 46 is desirably measured perpendicular to the undeflected path of travel 82 of the transfer belt. The acceptable amount of deflection for any given tissue web 40 is in part determined by the design of the transfer belt 46 and the tension imparted to the transfer belt during operation for guiding and running the transfer belt in an endless loop. As the tension is reduced, the acceptable amount of deflection will increase because the compression of the tissue web. is reduced and the amount of power transferred to the parent roll 52 is further reduced. In turn, the variability in the properties of the wound tissue web is reduced. In addition, it may not always be desirable to maintain the amount of transfer belt deflection D at a substantially constant level, and it is within the scope of the invention that the amount of deflection may be controllably varied as the parent roll 52 increases in diameter.

The sensed deflection D of the transfer belt 46 in combination with the sensed position of the reel spool carriages 73 may also be used to calculate the diameter of the building parent roll 52. The value calculated for the diameter of the parent roll 52 can be useful in varying other operating parameters of the winding process, including the rotational velocity at which the reel spool 54 is rotated by the drive motor 56 to maintain the same draw or speed relationship between the outer surface of the parent roll 52 and the transfer belt 46 as the diameter of the parent roll increases.

The laser displacement sensor 76 can be positioned to always measure the deflection of the transfer belt 46 at the midpoint the winding region 51 free span, regardless of the parent roll position, and the actual deflection can be calculated as described below. Alternatively, the laser displacement sensor 76 can traverse the free span with the parent roll nip such that the laser always measures the deflection directly under the midpoint of the winding nip. A further alternative is to mount the laser displacement sensor 76 for rotation so that the laser light source can be rotated to maintain a desired aim on the transfer belt 46.

In the situation where the laser position is fixed at the midpoint of the free span and the deflection is measured by the laser displacement sensor 76 at that point, the actual deflection at the parent roll nip point is calculated according to the position of the building parent roll 52, which traverses from one end of the open span to the other on the carriages 73 while it builds. Since the laser displacement sensor 76 is mounted in the middle of the free span of the transfer belt 46 between the two support rolls (48, 50) and only measures the deflection of the transfer belt at that position, the actual deflection at the nip is closely approximated by the measured deflection in the middle of the free span times the following ratio: the distance from the laser measurement point M to the nip point A of the support roll nearest the nip point C of the parent roll (support roll 50 in FIG. 3) divided by the distance from the nip point of the parent roll C to the nip point of that same support roll A. For purposes of this calculation, the nip points of the support rolls are the tangent points at which the undeflected path of travel 82 of the transfer belt in the free span contacts the support rolls. The nip point C of the parent roll is the midpoint of the wrap of the transfer belt 46 around the periphery of the parent roll 52.

This is illustrated in FIG. 3, where the actual deflection D is the measured deflection at point M (the midpoint of the free span) times the ratio of the distance MA to the distance CA. If the parent roll 52 was precisely in the middle of the free span, the ratio would be 1 and the laser would be measuring the actual deflection D. However, when the parent roll 52 is positioned on either side of the midpoint of the free span, the deflection of the transfer belt 46 measured by the laser at the midpoint is always less than the actual deflection at the transfer point.

The length of the unsupported winding zone 51 between the support rolls 48, 50 needs to be long enough to allow the new reel spool 54' to be placed between the upper support roll 48 and the full-sized parent roll 52. On the other hand, the free span needs to be short enough to prevent undo sagging of the transfer belt 46 so that the amount of tension can be minimized and the degree of deflection can be controlled. A suitable winding zone length can be from about 1 to about 5 meters, and more specifically from about 2 to about 3 meters.

The advantages of the apparatus and method according to the present invention allow the production of parent rolls of tissue having highly desirable properties. In particular, parent rolls of high bulk tissue can be manufactured having a diameter of about 70 inches or greater, wherein the bulk of the tissue taken from the roll is about 9 cubic centimeters per gram or greater, the coefficient of variation of the finished basis weight is about 2% or less and the coefficient of variation of the machine direction stretch is about 6% or less. In addition, the coefficient of variation of the web bulk for tissue webs taken from the parent roll can be about 3.0 or less.

More specifically, the diameter of the parent roll can be from about 100 to about 150 inches or greater. The coefficient of variation of the finished basis weight can be about 1% or less. The coefficient of variation of the machine direction stretch can be about 4% or less, still more specifically about 3% or less. The coefficient of variation of the web bulk can be about 2.0 or less.

As used herein, high bulk tissues are tissues having a bulk of 9 cubic centimeters or greater per gram before calendering. Such tissues are described in U.S. Pat. No. 5,607,551, entitled *Soft Tissue* that issued Mar. 4, 1997 to Farrington, Jr. et al. More particularly, high bulk tissues for purposes herein can be characterized by bulk values of from 10 to about 35 cubic centimeters per gram, and more specifically from about 15 to about 25 cubic centimeters per gram. The method for measuring bulk is described in the Farrington, Jr. et al. patent.

In addition, the softness of the high bulk tissues produced by the tissue machine in FIG. 2 can be characterized by a relatively low stiffness as determined by the MD Max Slope and/or the MD Stiffness Factor, the measurement of which is also described in the Farrington, Jr. et al. patent. More specifically, the MD Max Slope, expressed as kilograms per 3 inches of sample, can be about 10 or less, more specifically about 5 or less, and still more specifically from about 3 to about 6. The MD Stiffness Factor, expressed as (kilograms per 3 inches)-microns$^{0.5}$, can be about 150 or less, more specifically about 100 or less, and still more specifically from about 50 to about 100.

Furthermore, the high bulk tissues can have a machine direction stretch of about 10 percent or greater, more specifically from about 10 to about 30 percent, and still more specifically from about 15 to about 25 percent. In addition, the high bulk tissues suitably can have a substantially uniform density since they are preferably through-air dried to final dryness without any significant differential compression.

An advantage of the belted reel is the resulting improved uniformity in the web properties unwound from the parent roll. Very large parent rolls can be wound while still providing substantial web uniformity due to the control of the winding pressure on the web. Another advantage of the method of this invention is that soft, high bulk tissue webs can be wound into parent rolls at high speeds. Suitable machine speeds as measured on the through-air dryer can be from about 3000 to about 6000 feet per minute or greater, more specifically from about 4000 to about 6000 feet per minute or greater, and still more specifically from about 4500 to about 6000 feet per minute.

Other modifications and variations to the present invention may be practiced by those of ordinary skill in the art, without departing from the spirit and scope of the present invention, which is more particularly set forth in the appended claims. It is understood that aspects of the various embodiments may be interchanged in whole or part. All cited references, patents, or patent applications in the above application for letters patent are herein incorporated by reference in a consistent manner. In the event of inconsistencies or contradictions between the incorporated references and this application, the information present in this application shall prevail. The preceding description, given by way of example in order to enable one of ordinary skill in the art to practice the claimed invention, is not to be construed as limiting the scope of the invention, which is defined by the claims and all equivalents thereto.

We claim:

1. An apparatus for winding a web into a roll comprising:

a rotatably mounted reel spool;

an endless flexible belt mounted for rotation along a predetermined path of travel having a winding region and a web transport region, with the winding region positioned adjacent to the reel spool;

a displacement sensor measuring a deflection of the endless flexible belt from the predetermined path of travel in the winding region;

an actuator for positioning the reel spool and the endless flexible belt relative to each other to vary the deflection of the endless flexible belt;

a controller connected to the displacement sensor and the actuator for controlling the deflection of the endless flexible belt as the roll increases in diameter; and at least one static measurement probe measuring the charge of at least one of the endless flexible belt and the web, and at least one static induction device for inducing a static charge into at least one of the endless flexible belt and the web based on the measured charge.

2. An apparatus for winding a web of paper into a roll comprising:

a rotatably mounted reel spool;

a drive motor connected to the reel spool for winding a paper web thereon to create a parent roll of increasing diameter;

an air permeable endless flexible belt having an inside surface and an outside surface supported for rotation around a plurality of support rolls defining a predetermined path of travel, the predetermined path of travel having a winding region including a free span and a pair of support rolls, and a web transport region preceding the winding region, the paper web residing on the outside surface and positioned adjacent to the reel spool engaging the reel spool during winding such that the free span is deflected from the predetermined path of travel by the paper web winding on the reel spool;

a displacement sensor mounted within the endless flexible belt measuring a deflection of the inside surface from the predetermined path of travel;

an actuator for positioning the reel spool and the endless flexible belt relative to each other to vary the deflection of the Inside surface;

a controller connected to the displacement sensor and the actuator for controlling the deflection of the inside surface as the parent roll diameter increases; and at least one static measurement probe measuring the charge of at least one of the endless flexible belt and the paper web and at least one static induction device for inducing a static charge into at least one of the endless flexible belt and the web based on the measured charge.

3. The apparatus of claims 1 or 2 comprising a web static probe and a web static induction device located above the web in the web transport region, and an endless flexible belt static probe and an endless flexible belt static induction device located below the endless flexible belt in the web transport region.

4. The apparatus of claims 1 or 2 comprising a controller connected to the at least one static measurement probe and to the at least one static induction device for controlling the static charge at least one of the web and the endless flexible belt.

5. The apparatus of claim 3 comprising a controller connected to the web static probe and the endless flexible belt static probe and to the web static induction device and to the endless flexible belt static induction device for controlling the static charge of both the web and the endless flexible belt.

6. The apparatus of claim 4 wherein the static charge differential between the endless flexible belt and the web is maintained in the range of about 6 kv to about 20 kv.

7. The apparatus of claim 5 wherein the static charge differential between the endless flexible belt and the web is maintained in the range of about 6 kv to about 20 kv.

8. The apparatus of claim 4 wherein the static charge differential between the endless flexible belt and the web is maintained in the range of about 9 kv to about 18 kv.

9. The apparatus of claim 5 wherein the static charge difference between the endless flexible belt and the web is maintained in the range of about 9 kv to about 18 kv.

10. The apparatus of claim 5 wherein the static charge of the web is maintained in the range between about −20 kilovolts to about 0 kilovolts and the static charge of the endless flexible belt is maintained in the range between about +0 to about +20 kilovolts.

11. The apparatus of claim 5 wherein the static charge of the web is maintained in the range between about −20 kilovolts to about 0 kilovolts and the static charge of the endless flexible belt is maintained in the range between about +0 to about +20 kilovolts and the static charge differential is maintained in the range between about 6 kilovolts to about 20 kilovolts.

12. A method of winding a web to form a roll comprising the steps of:

engaging a reel spool against an endless flexible belt creating a nip such that the flexible belt is deflected from a predetermined path of travel, the endless flexible belt having a winding region, and a web transport region;

rotating the reel spool and the endless flexible belt;

advancing the web into the nip and directing the web around the reel spool to form a roll of increasing diameter;

sensing the amount of deflection of the endless flexible belt by the roll as the diameter of the roll increases;

moving at least one of the reel spool and the endless flexible belt in response to the sensing step to vary the amount of deflection of the endless flexible belt;

measuring the static charge of at least one of the web and the endless flexible belt; and inducing a static charge into at least one of the web and the endless flexible belt based on the measured charge.

13. The method of claim 12 comprising controlling the static charge differential between the web and the endless flexible belt.

14. The method of claim 12 wherein the controlling is done by a control system having a static measurement feedback loop.

15. The method of claim 12 or 13 wherein the static charge differential is maintained between about 6 kilovolts to about 20 kilovolts.

16. The method of claim 12 or 13 wherein the static charge differential is maintained between about 9 kilovolts to about 18 kilovolts.

* * * * *